US007433487B2

(12) United States Patent
Shimamura

(10) Patent No.: US 7,433,487 B2
(45) Date of Patent: Oct. 7, 2008

(54) SPEAKER

(75) Inventor: Naoki Shimamura, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 423 days.

(21) Appl. No.: 11/204,298

(22) Filed: Aug. 15, 2005

(65) Prior Publication Data

US 2006/0045305 A1 Mar. 2, 2006

(30) Foreign Application Priority Data

Aug. 27, 2004 (JP) ..... 2004-247959

(51) Int. Cl.
*H04R 1/00* (2006.01)
*H04R 9/06* (2006.01)
*H04R 11/02* (2006.01)

(52) U.S. Cl. ..... 381/414; 381/412; 381/422

(58) Field of Classification Search ..... 381/150–152, 381/160–167, 170–182, 184–186, 322–423; 335/284, 219, 306
See application file for complete search history.

(56) References Cited

U.S. PATENT DOCUMENTS 3,201,529 A * 8/1965 Surh ..... 381/186
3,983,337 A * 9/1976 Babb ..... 381/407
5,371,806 A * 12/1994 Kohara et al. ..... 381/420
5,452,366 A * 9/1995 Sakamoto et al. ..... 381/422
5,550,332 A * 8/1996 Sakamoto ..... 181/148
5,912,978 A * 6/1999 Eastty et al. ..... 381/397
6,466,682 B2 * 10/2002 An ..... 381/413
6,519,349 B1 * 2/2003 Azima et al. ..... 381/396
6,529,107 B2 * 3/2003 Shimizu et al. ..... 335/302
6,563,932 B2 * 5/2003 Cork ..... 381/412
6,567,528 B1 * 5/2003 Heed ..... 381/404
2003/0031338 A1 * 2/2003 Suzuki et al. ..... 381/398
2003/0034775 A1 * 2/2003 Schroeder et al. ..... 324/207.21

(Continued)

FOREIGN PATENT DOCUMENTS

EP 1191809 * 3/2002

(Continued)

OTHER PUBLICATIONS

Gould, J.; "Permanent Magnet Applications", Magnetics, IEEE Transactions on, vol. 5, Issue 4, Dec. 1969 pp. 812-821.*

(Continued)

*Primary Examiner*—Sinh Tran
*Assistant Examiner*—Ryan C Robinson
(74) *Attorney, Agent, or Firm*—Brinks Hofer Gilson & Lione

(57) ABSTRACT

A speaker includes a magnet, a yoke, and a coil. A surface of the magnet opposed to the yoke includes a first magnetized surface at one side in the moving direction of the coil and a second magnetized surface at the other side in the moving direction of the coil. The two magnetized surfaces have the same magnetic polarity. A central surface between the first magnetized surface and the second magnetized surface is not magnetized or is magnetized more weakly than the first magnetized surface and the second magnetized surface. The single magnet of this structure forms the same magnetic force distribution as two separate magnets so that the speaker provides a superior linearity of driving force of the coil.

19 Claims, 3 Drawing Sheets

U.S. PATENT DOCUMENTS

2003/0044040 A1* 3/2003 Lee et al. ..... 381/396
2003/0133587 A1* 7/2003 Hyre et al. ..... 381/412

FOREIGN PATENT DOCUMENTS

JP 4363999 12/1992
JP 08-140191 5/1996
JP 08-140191 A1 * 5/1996

OTHER PUBLICATIONS

Campbell, Peter "Permanent Magnet Materials and Their Application." Cambridge University Press 1994. (p. 53).*

* cited by examiner

SPEAKER

BACKGROUND

1. Field of the Invention

The present invention relates to a speaker including a voice coil driven by a single magnet and, in particular, to a speaker including a voice coil driven by a single magnet and providing the magnetic force distribution and performance identical to that of a speaker using two magnets.

2. Description of Related Art

In general, a speaker includes a frame, a diaphragm supported by the frame, and a magnetic driving unit. The magnetic driving unit includes a magnet attached to the frame, a magnetic yoke opposed to the magnet, and a coil (voice coil) which is disposed in a gap between the magnet and the opposing magnetic yoke and which moves along with the diaphragm.

In the magnetic driving unit, the coil is driven by an electromagnetic force induced by a magnetic flux emanating from the magnet to the magnetic yoke over the gap and the electrical current flowing in the coil located in the gap. Therefore, the diaphragm vibrates along with the coil to produce sound.

The strength of a magnetic field provided to the magnetic yoke by the magnetized surface of the magnet exhibits a peak at the center of the magnetized surface in the moving direction of the coil. In the vicinity of the center, as the distance from the center increases, the magnetic field strength gradually decreases. Accordingly, when the magnet opposing the gap is single and when the position where the moving coil faces the magnetized surface changes, the magnetic field through the coil changes in strength. Therefore, it is difficult to maintain the linearity of a driving force applied to the coil, which is a problem.

To address this problem, Japanese Patent No. 2917578 and Japanese Unexamined Patent Application Publication No. 8-140191 disclose a technology in which two magnets are provided with a space therebetween in the moving direction of a coil, and the coil is disposed in a gap between a yoke and the magnets such that the coil can face each magnetized surface of the two magnets. Since a single coil faces the two magnets, each of which has a peak of magnetic field strength, the large change in the strength of the magnetic field through the coil can be reduced when the coil moves. Thus, the linearity can be easily maintained. If the linearity of a driving force applied to the coil is maintained, the occurrence of sound distortion at high power output can be prevented.

The speaker disclosed in the above-described two publications uses two independent magnets so as to easily ensure the linearity of a driving force. However, the use of two magnets causes the following problems:

(1) The assembly of the speaker is difficult.

(2) The performance is not always the same among assembled speakers.

(3) The manufacturing cost increases.

As for the difficulty of assembly, the distance between the two magnets needs to be precisely determined in accordance with the length of the coil in the moving direction to ensure the linearity of a driving force applied to the coil. Accordingly, a tool such as a jig is required at assembly time in order to determine the positions of the two magnets. Furthermore, a complicated operation in which the two magnets are secured while determining their positions is required.

As for the uneven performance, it is difficult to manufacture speakers having two magnets with the same magnetic field strength and distribution. Thus, the magnetic field strengths of the two magnets are sometimes different. In this case, the linearity of a driving force applied to a coil disadvantageously differs from speaker to speaker.

As for the manufacturing cost, separately manufacturing two magnets increases the cost of a magnetic driving unit including the two magnets.

SUMMARY OF THE INVENTION

Accordingly, it is an object of the present invention to provide a speaker that can ensure the linearity of a driving force applied to a coil without using two independent magnets and that can be manufactured at low cost.

According to the present invention, a speaker includes a frame, a diaphragm supported by the frame, a magnetic circuit portion including a magnet and a yoke opposed to the magnet, and a coil disposed in a gap between the magnet and the yoke. The coil moves along with the diaphragm. In the speaker, a surface of the magnet opposed to the yoke includes a first magnetized surface at one side in the moving direction of the coil and a second magnetized surface at the other side, the two magnetized surfaces have the same magnetic polarity, the surface of the magnet opposed to the yoke further includes a central surface between the first magnetized surface and the second magnetized surface, and the central surface is not magnetized or is magnetized more weakly than the first magnetized surface and the second magnetized surface.

According to the present invention, the first and second magnetized surfaces generate a magnetic field having two peaks. In addition, the central surface easily separates the magnetic field induced by the first magnetic surface from the magnetic field induced by the second magnetic surface. Therefore, the magnet can ensure the linearity of driving force of the coil as in the case where two independent magnets are spaced. Furthermore, since a single magnet is used, the cost of the magnet is low. Still furthermore, the differences in magnetic field strength and magnetic field distribution induced by the two magnetized surfaces can be small, thus providing speakers having the same driving performance.

According to the present invention, the above-described magnet includes a central portion having the above-described central surface. The central portion is not magnetized or is weakly magnetized.

According to the present invention, the length of the coil in the moving direction is preferably equal to a distance between peak points of magnetic force strength induced by the first magnetized surface and the second magnetized surface. This distance can easily achieve the linearity of driving force of the coil. Also, for example, the length of the coil in the moving direction is preferably equal to a distance between the center positions of the lengths of the first magnetized surface and the second magnetized surface in the moving direction of the coil. Furthermore, the length of the first magnetized surface is preferably equal to that of the second magnetized surface in the moving direction of the coil.

The spacing of the gap is preferably constant within the moving range of the coil. Additionally, the magnet is preferably a ring magnet radially polarized and magnetized to reduce the weight.

According to the present invention, a single magnet can ensure the linearity of driving force of a coil. In addition, a single magnet having two magnetized surfaces reduces the difference in magnetic field strength and its distribution induced by the two magnetized surfaces. Therefore, the linearity of driving force can be easily provided. Also, speakers using this magnet have substantially the same linearity characteristic. Furthermore, using a single magnet can reduce the manufacturing cost of the speaker.

DETAILED DESCRIPTION OF PREFERRED EMBODIMENTS

Figure 1:
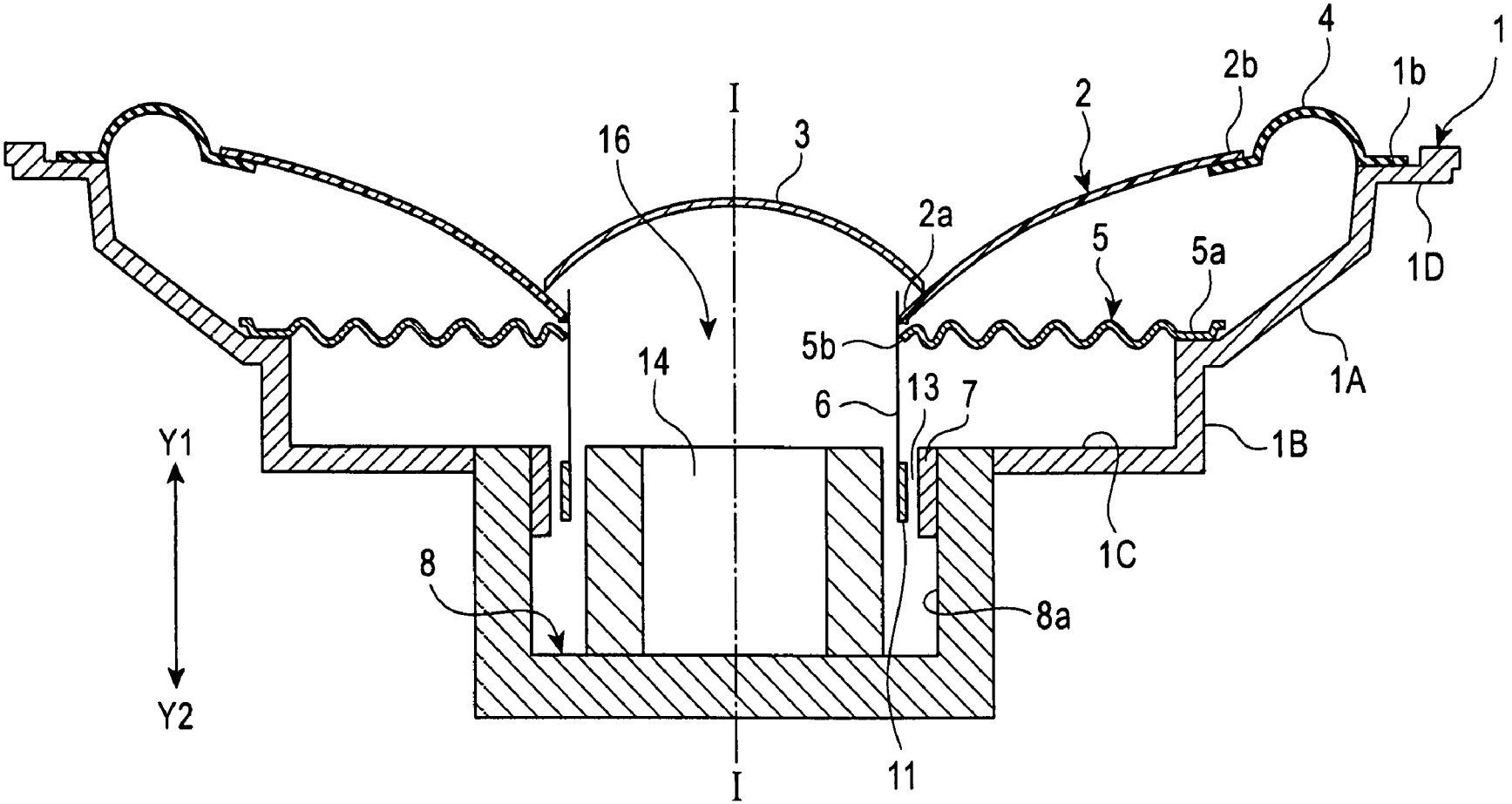
FIG. 1 is a sectional view of the entire structure of a speaker according to an embodiment of the present invention.

As shown in FIG. 1, a speaker generally includes a frame 1, a diaphragm 2, and a magnetic driving unit 16. In FIG. 1, a center line (center axis) extending in the direction Y1-Y2, which is a fore and aft direction of the speaker, is shown as a line I-I. The sound output from the speaker travels in the Y1 direction.

The frame 1 is formed from a nonmagnetic metal material (e.g., an aluminum alloy) by die casting. Alternatively, the frame 1 may be formed from a synthetic resin by injection molding. The frame 1 has a horn shape with an opening in the Y1 direction, and the axis thereof coincides with the center line I-I. The frame 1 includes, in series, a tapered portion 1A whose inner diameter gradually increases towards the Y1 direction, a cylinder portion 1B extending from the small-diameter end of the tapered portion 1A towards the rear of the frame 1 (in the Y2 direction), and a bottom portion 1C connected to the cylinder portion 1B.

The diaphragm 2 is formed from a resin or a paper material into a cone shape. The front end of a cylindrical bobbin 6 is secured to the inner periphery 2*a* of a hole formed at the center of the diaphragm 2 by bonding. The front end of the bobbin 6 is also closed by a cap 3 having a dome shape. A ring-shaped outer-periphery supporting plate 4 is bonded to the entire outer periphery 2*b* of the diaphragm 2. The outer-periphery supporting plate 4 is formed from a thin-walled elastic sheet material, such as a butyl rubber. The outer-periphery supporting plate 4 has an arc shape in cross section. The outer periphery of the outer-periphery supporting plate 4 is secured, by bonding, to a mounting surface 1*b* of a flange portion 1D provided at the periphery of the frame 1 on the front side.

A damper 5 is formed from a resin-impregnated cloth or a thin resin plate into a ring shape. A plurality of irregular portions is concentrically formed on the damper 5 in the radial direction by a corrugating operation. An inner peripheral portion 5*b* of the damper 5 is secured to the bobbin 6 by bonding, whereas the outer peripheral portion 5*a* of the damper 5 is secured to the inner surface of the frame 1 by bonding.

The magnetic driving unit 16 includes a magnetic circuit portion and a coil (voice coil) 11 secured to the bobbin 6.

The magnetic circuit portion includes a cup-shaped holder yoke 8 made from a magnetic material. The holder yoke 8 is connected and secured to a center hole formed in the bottom portion 1C of the frame 1.

Figure 2:
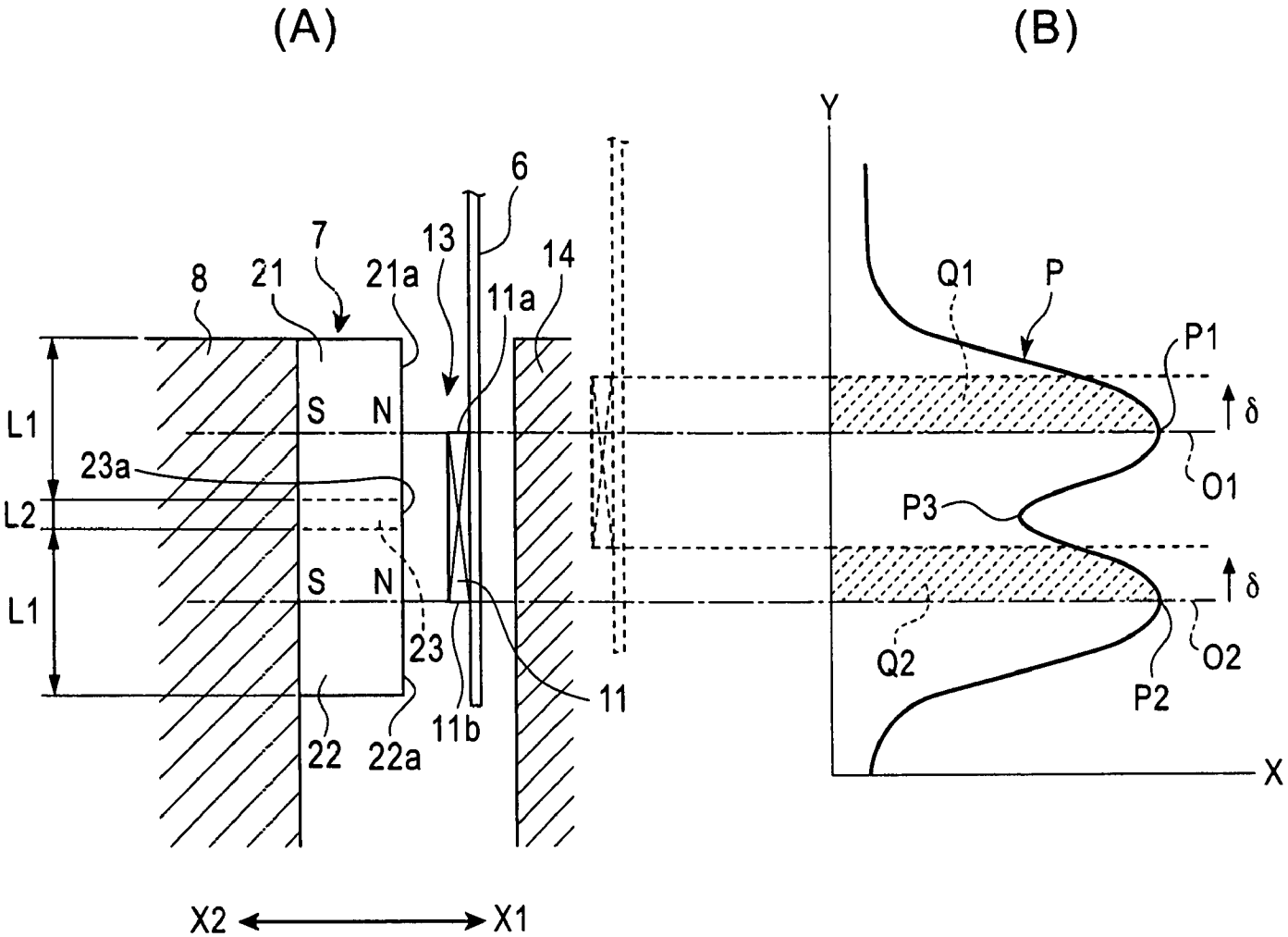
FIG. 2(A) is an enlarged sectional view of a gap portion of the speaker shown in FIG. 1.
FIG. 2(B) illustrates the distribution of magnetic field strength in the gap.

A cylindrical magnetic yoke 14 is secured at the center of the holder yoke 8. A ring-shaped magnet 7 is secured to the inner peripheral surface 8*a* of the holder yoke 8 by, for example, bonding. As used herein, the magnet 7 refers to a single magnet extending in the fore and aft direction (i.e., Y1-Y2 direction) shown in cross sectional views in FIGS. 1 and 2. That is, the magnet 7 is not divided into a plurality of magnets in the fore and aft direction. Therefore, even though the magnet 7 is circumferentially divided into two or more portions, the magnet 7 is considered to be a single magnet. Thus, the magnetic circuit portion is composed of the holder yoke 8, the magnetic yoke 14, and the magnet 7.

As shown in FIG. 2(A), a gap 13 is formed between the inner peripheral surface of the magnet 7 and the outer peripheral surface of the magnetic yoke 14. The length of the gap 13 in the radial direction (i.e., gap spacing) is uniform both in the fore and aft direction (Y1-Y2 direction) and in the circumferential direction. The gap 13 has a cylindrical shape with a radius of a constant length from the center line I-I. The bobbin 6 has also a cylindrical shape with a radius of a constant length from the center line I-I. The bobbin 6 and the coil 11 are interposed into the gap 13. In the gap, the bobbin 6 and the coil 11 can move forwards and backwards along with the diaphragm 2 without being brought into contact with the magnet 7 or the magnetic yoke 14.

As shown in FIG. 2(A), the magnet 7 has a ring shape with a predetermined thickness in the radial direction (X1-X2 direction). The magnet 7 includes three portions in the fore and aft direction (Y1-Y2 direction): a first magnetized portion 21, a central portion 23, and a second magnetized portion 22. The first magnetized portion 21 has a first magnetized surface 21*a* facing the gap 13, and the second magnetized portion 22 has a second magnetized surface 22*a* facing the gap 13. The central portion 23 has a central surface 23*a* facing the gap 13.

In an example shown in FIG. 2(A), the magnet 7 is radially polarized so that the first magnetized surface 21*a* has the N pole, and an area which is on the outer peripheral surface (X2 side) and which is opposed to the first magnetized surface 21*a* has the S pole. Similarly, the second magnetized surface 22*a* has the N pole, and an area which is on the outer peripheral surface and which is opposed to the second magnetized surface 22*a* has the S pole. That is, the magnet 7 is polarized so that the first magnetized surface 21*a* and the second magnetized surface 22*a* have the same magnetic polarity. The central portion 23 is not magnetized, and therefore, the central surface 23*a* is a non-magnetized surface. It should be noted that the N- and S-polarities in the description above are reversible.

To magnetize the magnet 7, a magnetizing yoke, to which a magnetizing electrical magnet provides magnetic fluxes, is brought into contact with the first magnetized surface 21*a* and the opposed surface area. Also, the magnetizing yoke is brought into contact with the second magnetized surface 22*a* and the opposed surface area. Thereafter, the same amount of magnetizing flux is provided to the first magnetized portion 21 and the second magnetized portion 22. Since the first magnetized portion 21 and the second magnetized portion 22 are included in the single magnet 7, the first magnetized portion 21 and the second magnetized portion 22 have the same properties of magnetic material and the same thickness (inner diameter and dimensions). Since the same amount of magnetizing flux (i.e., magnetizing fluxes of the same strength) is provided to the first magnetized portion 21 and the second magnetized portion 22, the first magnetized surface 21*a* and the second magnetized surface 22*a* can be magnetized so that the first magnetized surface 21*a* and the second magnetized surface 22*a* have the same coercive field strength and the same coercive field distribution.

As described above, the magnetizing yoke faces only the first magnetized portion 21 and the second magnetized portion 22, and not the central portion 23. Accordingly, magnetizing fluxes are not provided to the central portion 23. Thus, basically, the central portion 23 is not magnetized. However, the magnetizing fluxes provided to the first magnetized portion 21 and the second magnetized portion 22 may leak into the central portion 23. In this case, the central portion 23 may be slightly magnetized. Therefore, the central surface 23*a* is not limited to a non-magnetized surface. The central portion 23 may be a surface magnetized more weakly than the first magnetized surface 21*a* and the second magnetized surface 22*a*.

In FIG. 2(A), a border between the first magnetized portion 21 and the central portion 23 and a border between the second magnetized portion 22 and the central portion 23 are shown by dotted straight lines. However, in practice, the border is not so clear, and therefore, the border is not always a straight line. In FIG. 2(A), the length of each of the first magnetized portion 21 and the second magnetized portion 22 in the fore and aft direction (Y1-Y2 direction) is L1. The length of the central portion 23 is L2. Since the borders are not always clear, the lengths are not always clearly determined. However, the length L1 can be considered the range of an area where magnetizing fluxes are provided. Also, the length L2 can be considered the range of an area where no magnetizing flux is provided.

The length L2 is preferably in the range of about 10 to 40% of the length L1.

In the magnetic circuit portion, which includes the magnet 7, the magnetic yoke 14, and the holder yoke 8, a magnetic circuit is formed so that magnetic fluxes emitted from the magnet 7 propagate across the gap 13, reach the magnetic yoke 14, and return from the holder yoke 8 to the magnet 7. FIG. 2(B) illustrates the distribution of magnetic field strength along the center line of the spacing of the gap 13, namely, along the center line of the coil 11 in the radial direction (the center line between the outer and inner peripheral surfaces in FIG. 2(A)). In the drawing, the abscissa X represents the magnetic field strength and the ordinate Y represents a position along the Y1-Y2 direction.

As described above, in the single magnet 7, only the first magnetized portion 21 and the second magnetized portion 22 are magnetized, whereas the central portion 23 is not magnetized effectively. This results in a first peak P1 and a second peak P2 being exhibited in the distribution of the magnetic flux produced. Also, a strength decreasing portion P3 where the magnetic field strength significantly decreases appears between the first peak P1 and the second peak P2.

The position of the first peak P1 in the fore and aft direction substantially coincides with the middle point of the length L1 of the first magnetized surface 21*a*. The position of the second peak P2 in the fore and aft direction substantially coincides with the middle point of the length L1 of the second magnetized surface 22*a*.

The length of the coil 11 in the fore and aft direction is equal to or substantially equal to the distance between the positions of the first peak P1 and the second peak P2. Therefore, the length of the coil 11 is equal or substantially equal to a distance between the middle point that divides the first magnetized surface 21*a* into halves in the fore and aft direction and the middle point that divides the second magnetized surface 22*a* into halves in the fore and aft direction.

When the first magnetized surface 21*a* and the second magnetized surface 22*a* are formed on the single magnet 7, the magnetic field strength of the first peak P1 is substantially identical to that of the second peak P2, as shown in FIG. 2(B). Additionally, the strength decreasing portion P3, where the magnetic field strength significantly decreases, appears in a space opposed to the central surface 23*a*. Accordingly, in the distribution of magnetic field strength, the magnetic field strength substantially symmetrically decreases as a position moves forwards and backwards away from the position of the first peak P1. Similarly, the magnetic field strength substantially symmetrically decreases as a position moves forwards and backwards away from the position of the second peak P2.

As a result, the linearity of a driving force can be ensured when the coil 11 is driven by an electromagnetic force in a fore and aft direction. As used herein, "linearity" means that an electromagnetic force does not vary significantly when the coil 11 provided with a constant electrical current moves forwards and backwards.

The "linearity" is described next with reference to FIGS. 2(A) and 2(B) when, as shown by a solid line, the bottom end 11*b* of the coil 11 is positioned at the point of the second peak P2 and the top end 11*a* of the coil 11 is positioned at the point of the first peak P1, the coil 11 moves upwards by a distance δ, as shown by a dotted line. Here, the magnetic field strength symmetrically decreases from the position of the first peak P1 in the forward direction and the backward direction. Also, the magnetic field strength symmetrically decreases from the position of the second peak P2 in the forward direction and the backward direction. Consequently, when considering two integral values: Q2 that is calculated by integrating the decrease in magnetic field strength caused by offsetting the coil the moving distance δ when the bottom end 11*b* of the coil 11 moves up from the point of the second peak P2 by the distance δ, and Q1 that is calculated by integrating the increase in magnetic field strength provided to the coil when the top end 11*a* of the coil 11 moves up from the point of the first peak P1 by the distance δ, the integral value Q2 is substantially identical to the integral value Q1.

This indicates that, when the coil 11 moves in the fore and aft direction, the total amount of the magnetic field propagating across the coil 11 remains substantially constant. Therefore, the linearity can be ensured.

Figure 3:
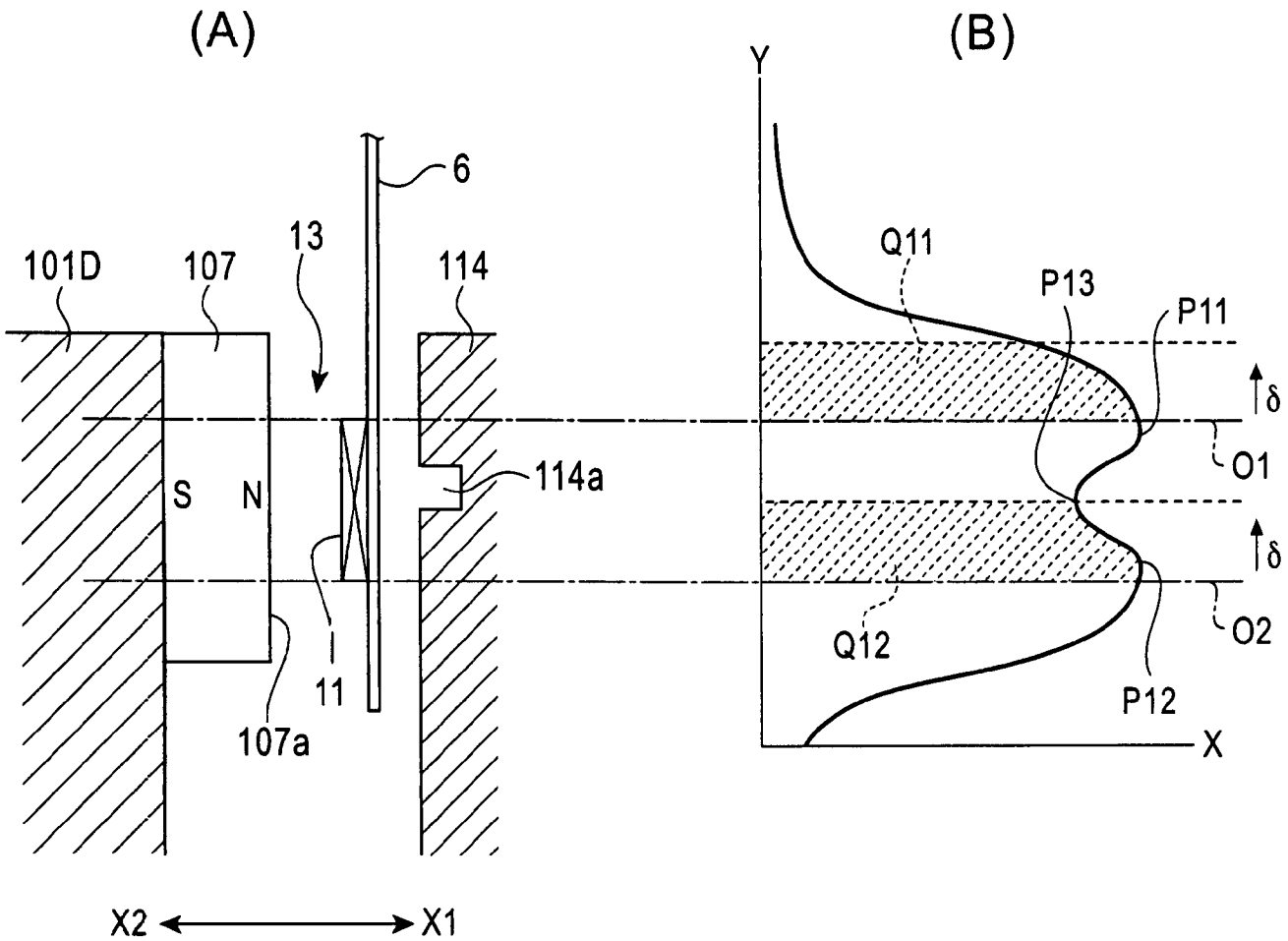
FIG. 3(A) is an enlarged sectional view of a gap portion of a speaker in a comparison example.
FIG. 3(B) illustrates the distribution of magnetic field strength in the gap in the comparison example.

FIGS. 3(A) and 3(B) illustrate a comparative example in order to make the effect of the embodiment of the present invention more clear.

In this comparative example, the whole body of a magnet 107 supported by a holder yoke 101D is magnetized. The entire surface 107*a* of the magnet 107 facing the gap 13 is magnetized. In contrast, a recess portion 114*a* is formed on the surface of a magnetic yoke 114 facing the gap 13. The recess portion 114*a* is opposed to the middle point of the length of the magnet 107 in the fore and aft direction.

In the distribution of magnetic field strength inside the gap 13, as shown in FIG. 3(B), the decrease in the magnetic field strength is reduced at a strength decreasing portion P13. Thus, the distribution of magnetic field strength from the point of a first peak P11 and the distribution of magnetic field strength from the point of a second peak P12 are not symmetric in the fore and aft direction.

Consequently, when, as in the embodiment shown in FIG. 2(B), considering an integral value Q12 of decreased magnetic field caused by offsetting the coil 11 and an integral value Q11 of increased magnetic field provided to the coil 11 in the case where the coil 11 moves upwards by a distance δ, a significant difference exists between the integral values Q11 and Q12. Accordingly, unlike the embodiment shown in FIG. 2(B), the linearity of a driving force in this comparative example varies as the coil 11 moves.

According to the present invention, the magnet 7 alternatively may be secured to the outer peripheral surface of the magnetic yoke 14 (an inner yoke), and the gap 13 may be formed between the outer peripheral surface of the magnet 7 and the inner peripheral surface 8*a* of the holder yoke 8.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

The invention claimed is:

1. A speaker comprising:

a frame;

a diaphragm supported by the frame;

a magnetic circuit portion including a magnet and a yoke portion opposed to the magnet; and a coil disposed in a gap between the magnet and the yoke portion, the coil moving along with the diaphragm;

wherein a surface of the magnet opposed to the yoke portion includes a first magnetized portion disposed at one side of the surface of the magnet in the moving direction of the coil and a second magnetized portion disposed at an opposite side of the surface of the magnet, the first and second magnetized portions have the same magnetic polarity, the surface of the magnet opposed to the yoke portion includes a central portion disposed between the first magnetized portion and the second magnetized portion, and the central portion has a magnetization that is weaker than the first magnetized portion and the second magnetized portion.

2. The speaker according to claim 1, wherein the length of the coil in the moving direction is substantially equal to a distance between a peak position of magnetic force field strength of the first magnetized portion and a peak position of magnetic force field strength of the second magnetized portion.

3. The speaker according to claim 1, wherein the length of the coil in the moving direction is substantially equal to a distance between a center of the first magnetized portion in the moving direction and a center of the second magnetized portion in the moving direction.

4. The speaker according to claim 3, wherein the length of the first magnetized portion in the moving direction of the coil is substantially equal to the length of the second magnetized portion in the moving direction of the coil.

5. The speaker according to claim 1, wherein the magnet and the yoke portion are spaced radially apart at substantially constant distance within a moving range of the coil.

6. The speaker according to claim 1, wherein the magnet comprises a ring magnet radially polarized and magnetized.

7. The speaker according to claim 1, wherein the central portion is not magnetized.

8. A speaker comprising:

a frame;

a diaphragm supported by the frame;

a magnetic circuit portion including a magnet and a yoke portion opposed to the magnet; and a coil disposed in a gap between the magnet and the yoke portion, the coil moving along with the diaphragm;

wherein a surface of the magnet opposed to the yoke portion includes a first magnetized portion disposed at one side of the surface of the magnet in the moving direction of the coil and a second magnetized portion disposed at the opposite side of the surface of the magnet, the first and second magnetized portions have the same magnetic polarity, the surface of the magnet opposed to the yoke portion includes a central portion disposed between the first magnetized portion and the second magnetized portion, and the central portion has a magnetization that is weaker than the first magnetized portion and the second magnetized portion, and wherein the length of the coil in the moving direction is substantially equal to a distance between a center of the first magnetized portion in the moving direction and a center of the second magnetized portion in the moving direction.

9. The speaker according to claim 8, wherein the length of the coil in the moving direction is substantially equal to a distance between a peak position of magnetic force field strength of the first magnetized portion and a peak position of magnetic force field strength of the second magnetized portion.

10. The speaker according to claim 8, wherein the length of the first magnetized portion in the moving direction is substantially equal to the length of the second magnetized portion in the moving direction of the coil.

11. The speaker according to claim 8, wherein the magnet and the yoke portion are spaced radially apart at a substantially constant distance within a moving range of the coil.

12. The speaker according to claim 8, wherein the magnet includes a ring magnet radially polarized and magnetized.

13. The speaker according to claim 8, wherein the central portion is not magnetized.

14. A speaker comprising:

a frame;

a diaphragm supported by the frame;

a magnetic circuit portion including a magnet and a yoke portion opposed to the magnet; and a coil disposed in a gap between the magnet and the yoke portion, the coil moving along with the diaphragm;

wherein the magnet is a ring magnet radially polarized and magnetized, a surface of the magnet opposed to the yoke portion includes a first magnetized portion disposed at one side of the surface of the magnet in the moving direction of the coil and a second magnetized portion disposed at the other side of the surface of the magnet, the first and second magnetized portion have the same magnetic polarity, the surface of the magnet opposed to the yoke portion includes a central portion dispose between the first magnetized portion and the second magnetized portion, and the central portion has a magnetization that is weaker than the first magnetized portion and the second magnetized portion.

15. The speaker according to claim 14, wherein the length of the coil in the moving direction is substantially equal to a distance between a peak position of magnetic force field strength of the first magnetized portion and a peak position of magnetic force field strength of the second magnetized portion.

16. The speaker according to claim 14, wherein the length of the coil in the moving direction is substantially equal to a distance between a center of the first magnetized portion in the moving direction and a center of the second magnetized portion in the moving direction.

17. The speaker according to claim 16, wherein the length of the first magnetized portion in the moving direction is substantially equal to the length of the second magnetized portion in the moving direction.

18. The speaker according to claim 14, wherein the magnet and the yoke portion are spaced radially apart at a substantially constant distance within a moving range of the coil.

19. The speaker according to claim 14, wherein the central portion is not magnetized.

* * * * *